US012716696B2

(12) United States Patent
Brooks et al.

(10) Patent No.: US 12,716,696 B2
(45) Date of Patent: Aug. 25, 2026

(54) TARGET FOR USE IN FIREARMS TRAINING

(71) Applicant: Marathon Robotics Pty Ltd, Hornsby (AU)

(72) Inventors: Alex Brooks, Newtown (AU); Trent Gutteridge, Pyrmont (AU); Alex Makarenko, Erskineville (AU)

(73) Assignee: Marathon Robotics Pty Ltd, Hornsby (AU)

( * ) Notice: Subject to any disclaimer, the term of this patent is extended or adjusted under 35 U.S.C. 154(b) by 0 days.

(21) Appl. No.: 17/636,300

(22) PCT Filed: Aug. 21, 2020

(86) PCT No.: PCT/AU2020/050873
§ 371 (c)(1),
(2) Date: Feb. 17, 2022

(87) PCT Pub. No.: WO2021/030874
PCT Pub. Date: Feb. 25, 2021

(65) Prior Publication Data

US 2022/0276028 A1 Sep. 1, 2022

(30) Foreign Application Priority Data

Aug. 21, 2019 (AU) ..... 2019903041

(51) Int. Cl.
*F41J 2/02* (2006.01)
*F41J 13/02* (2009.01)

(52) U.S. Cl.
CPC ..... *F41J 2/02* (2013.01); *F41J 13/02* (2013.01)

(58) Field of Classification Search
CPC . F41J 2/02; F41J 2/00; F41J 5/00; F41J 5/06; F41J 9/08; F41J 5/04; F41J 5/24; F41J 13/02
See application file for complete search history.

(56) References Cited

U.S. PATENT DOCUMENTS 3,410,559 A * 11/1968 Miller, Jr. ..... F41J 9/08 250/493.1
3,656,056 A * 4/1972 Dalzell, Jr. ..... F41J 5/044 73/167
3,784,836 A * 1/1974 Tolliver ..... F21V 7/09 392/421

(Continued)

FOREIGN PATENT DOCUMENTS

DE 3832534 A1 * 4/1990 ..... F41J 2/02
FR 2544067 A1 10/1984

(Continued)

OTHER PUBLICATIONS

International Preliminary Report on Patentability under Chapter II for International Application No. PCT/AU2020/050873 mailed Aug. 23, 2021, 12 pages.

*Primary Examiner* — Nicholas J. Weiss
*Assistant Examiner* — Amir A Klayman
(74) *Attorney, Agent, or Firm* — Greenberg Traurig, LLP

(57) ABSTRACT

Targets for use in training personnel in the operation of thermal imaging systems are described, the targets include: an internal cavity; an electrically powered heat source; the heat source is arranged to introduce heat to the internal cavity to cause warming of the target to thereby generate a heat signature.

23 Claims, 12 Drawing Sheets

(56) References Cited

U.S. PATENT DOCUMENTS 3,986,394 A * 10/1976 Greenlees ..... F42C 13/04 73/167
4,035,613 A * 7/1977 Sagawa ..... H05B 3/18 219/535
4,128,204 A * 12/1978 Wade ..... F24T 10/10 126/633
4,226,292 A * 10/1980 Monte ..... B62D 55/06 180/9.1
4,240,212 A * 12/1980 Marshall ..... F41G 3/26 273/348
4,253,670 A * 3/1981 Moulton ..... F41J 2/02 273/348
4,260,160 A * 4/1981 Ejnell ..... F41J 2/02 250/503.1
4,346,901 A * 8/1982 Booth ..... F41J 2/02 273/408
4,398,722 A * 8/1983 Morris ..... F41J 5/02 434/22
4,405,132 A * 9/1983 Thalmann ..... F41J 2/02 273/348.1
4,419,669 A * 12/1983 Slager ..... F41J 2/00 342/6
4,435,645 A * 3/1984 Bartle ..... F41G 7/303 250/493.1
4,505,481 A 3/1985 Knight
4,521,780 A * 6/1985 Preikschat ..... G01S 7/4052 342/170
4,546,983 A * 10/1985 Rosa ..... F41J 2/02 342/9
4,562,337 A * 12/1985 Lawrence ..... B23K 3/0646 219/442
4,625,973 A * 12/1986 Dallaire ..... F41J 9/02 273/366
4,792,142 A * 12/1988 Davies ..... F41J 2/02 273/348.1
4,949,972 A * 8/1990 Goodwin ..... F41J 5/02 273/408
5,012,250 A * 4/1991 Foley ..... G01S 7/4052 342/170
5,065,032 A * 11/1991 Prosser ..... F41J 2/02 250/493.1
5,066,019 A * 11/1991 Dean ..... F41J 2/02 250/493.1
5,110,137 A 5/1992 Watkins et al.
5,222,741 A * 6/1993 Redl ..... F41J 7/04 273/393
5,238,406 A * 8/1993 Littell, III ..... F41G 7/224 434/21
5,639,093 A * 6/1997 Law ..... F41J 5/18 273/371
5,814,754 A * 9/1998 Mangolds ..... B63G 9/02 342/10
5,901,959 A * 5/1999 Tessiot ..... F41J 2/02 273/359
5,924,694 A * 7/1999 Kent ..... F41J 1/01 273/408
5,969,369 A * 10/1999 Fogarty ..... F41J 2/02 250/504 R
6,315,294 B1 * 11/2001 Belleville ..... F41J 2/02 273/407
6,337,475 B1 * 1/2002 Migliorini ..... F41J 2/02 250/208.1
6,767,015 B1 * 7/2004 Parsley ..... F41J 2/02 273/348.1
6,768,126 B2 * 7/2004 Novak ..... H05B 3/28 250/493.1
6,806,480 B2 * 10/2004 Reshef ..... G09B 9/003 250/495.1
7,939,802 B2 * 5/2011 Guinn ..... F41J 2/02 250/330
7,990,927 B2 * 8/2011 Choi ..... H04W 72/563 370/335
8,125,369 B1 * 2/2012 Kang ..... B63G 13/02 342/9
8,561,993 B2 * 10/2013 Preston ..... F41J 7/06 273/374
8,757,627 B1 * 6/2014 Sedlacek ..... F41J 1/00 273/403
8,770,976 B2 * 7/2014 Moser ..... F41J 9/02 434/11
8,985,585 B2 * 3/2015 Hodge ..... F41J 5/02 273/348.1
9,222,762 B2 * 12/2015 Dillard ..... F42B 12/70
9,312,605 B2 * 4/2016 Sjölund ..... H01Q 17/00
9,797,694 B1 * 10/2017 Cummins ..... F41J 1/10
10,072,910 B2 * 9/2018 Kim ..... F41J 2/02
10,386,161 B1 * 8/2019 Snell ..... F41J 5/24
10,473,440 B1 * 11/2019 Ferrelli ..... B32B 27/32
10,809,042 B2 * 10/2020 Brooks ..... F41J 7/04
12,016,089 B1 * 6/2024 Miele ..... H05B 3/12
12,203,731 B1 * 1/2025 Gibson ..... F41H 11/00
12,281,944 B2 * 4/2025 Fielding ..... F41J 2/02
2005/0153262 A1 * 7/2005 Kendir ..... F41G 3/2655 434/21
2007/0205560 A1 9/2007 Hebble
2008/0169609 A1 * 7/2008 Hetland ..... F41J 7/06 264/105
2011/0042900 A1 * 2/2011 Hutchinson ..... F41J 2/02 273/381
2011/0175292 A1 * 7/2011 Carni ..... F41J 2/02 273/348.1
2012/0074645 A1 * 3/2012 Hodge ..... F41J 7/04 273/127 D
2013/0147117 A1 * 6/2013 Graham ..... F41J 7/04 273/393
2013/0228974 A1 * 9/2013 Davis, Jr. ..... F41J 5/24 273/378
2014/0232067 A1 * 8/2014 Barry ..... F41J 1/10 273/386
2016/0010958 A1 * 1/2016 Lessnick ..... F41J 5/24 434/19
2016/0033240 A1 * 2/2016 Graham ..... F41J 7/04 273/371
2017/0248393 A1 * 8/2017 Soukos ..... F41J 1/10
2018/0202776 A1 * 7/2018 Huang ..... F41J 5/00
2019/0195602 A1 * 6/2019 Udrea ..... G01J 5/53
2019/0339046 A1 * 11/2019 Herrmann ..... F41J 5/14
2020/0232769 A1 * 7/2020 Boyer ..... F41J 2/02
2021/0207931 A1 * 7/2021 Tendon ..... F41J 7/00
2022/0018636 A1 * 1/2022 Yedaya ..... F41J 2/02
2022/0307804 A1 * 9/2022 Amman ..... F41J 2/02
2022/0316952 A1 * 10/2022 Fielding ..... G01J 5/53

FOREIGN PATENT DOCUMENTS

GB 2123125 A 1/1984
JP S60152897 A 8/1985

* cited by examiner

TARGET FOR USE IN FIREARMS TRAINING

CROSS REFERENCE TO RELATED APPLICATIONS

The present application is a 371 U.S. National Stage of International Application No. PCT/AU2020/050873, filed Aug. 21, 2020, which claims the benefit of the earlier filing date of Australian Patent Application No. 2019903041 filed on Aug. 21, 2019, which are each incorporated herein by reference in their entirety.

TECHNICAL FIELD

The present invention relates to targets for use in training personnel in the operation of thermal imaging systems and particularly relates to three dimensional targets which generate a realistic heat signature when viewed with a thermal imaging system.

BACKGROUND TO THE INVENTION

Thermal imaging systems are sensitive to infrared radiation. Generally speaking, the higher an object's temperature, the more infrared radiation it emits.

Thermal imaging systems are very useful for military, law-enforcement and rescue personnel, and hunters. They are commonly affixed to weapons and have an aiming reticle (e.g. crosshairs)—this is known as a thermal scope or thermal sight. Thermal sights are becoming more prevalent, and therefore there is an increasing need for realistic targets (including moving targets) for training.

One option for a target is the use of a passive thermal target. These targets are generally two dimensional and consist of a shape or pattern formed from a reflective material which is mounted on a backing board. These types of target typically need to be slanted back from the line of sight to the firer by 10 degrees or more.

It has been tried to provide three dimensional thermal moving robotic targets based on applicant's previously filed international patent application no WO2011/035363, the contents of which are incorporated herein by reference. Specifically, it has been tried to modify the types of targets to produce a signature by placing a bag made of reflective material over the target so that it roughly conforms to the outer shape of the target.

However, passive thermal targets have various shortcomings as follows:

1. They provide an inverted image: i.e. a cold shape against a warmer background. This is enough to provide a contrasted image so that the observer or firer can see the target. However, this arrangement does not faithfully simulate a real world situation where the observer would see a warm shape against a cold background;
2. They are somewhat weather dependent: passive targets work best with clear skies; and
3. They tend to have a weak temperature contrast: the targets can be difficult to see from a distance.

It has been tried to provide active thermal targets to simulate vehicle targets by applying planar shaped heating pads to a two dimensional target backing board. These targets are either static (popup) or move on rails. 2D patches are applied at selected locations of the target which are known to get hot, leaving the rest of the target shape unheated. For instance, a car shaped backing board could be fitted with heated pads at locations known to heat up in a vehicle, such as front wheels, rear wheels, and engine block. However, these targets do not look particularly realistis when viewed through a thermal scope or sight.

There remains a need to provide three dimensional targets which give off a realistic heat signature when viewed through a thermal scope or sight.

SUMMARY OF THE INVENTION

In a first aspect the present invention provides a target for use in training personnel in the operation of thermal imaging systems, the target including: an internal cavity; an electrically powered heat source; the heat source is arranged to introduce heat to the internal cavity to cause warming of the target to thereby generate a heat signature.

The heat source may be at least partially located outside the cavity.

The heat source may be arranged to introduce heat to the cavity by convection.

The target may include a fan to assist convection.

The target may be arranged to introduce waste heat derived from on-board systems of the target into the cavity.

The heat source may be arranged to introduce heat to the cavity by radiation.

The heat source may be at least partially located within the cavity.

The heat source may be arranged to introduce heat to the cavity by radiation.

The heat source may be formed from one or more planar layers which have been rolled up to form a heating element.

At least one of the layers may be formed from a resistive material.

The heat source may be arranged to apply heat to predetermined regions of the inside surface of the cavity by conduction to create hot spots on the target.

The target may have the outer appearance of a person.

The target may further include at least one object with heat insulating properties which overlies an area of the target which will become warm in use to thereby create a cold spot on the target.

The at least one object may include any of eyewear, clothing, headgear and simulated weaponry.

The target may have the outer appearance of a vehicle.

The target may further include at least one acoustic sensor which is arranged to detect sounds inside the internal cavity to thereby detect bullet strikes.

The target may further include at least one vibrational sensor which is arranged to detect vibrations of the target body to thereby detect bullet strikes on the target.

BRIEF DESCRIPTION OF THE DRAWINGS

An embodiment of the present invention will now be described, by way of example only, with reference to the accompanying drawings, in which.

DETAILED DESCRIPTION OF THE PREFERRED EMBODIMENT

Embodiments of the invention will now be described with particular reference to the use of targets for use in training personnel in the use of thermal weapon sights. The targets are intended for use in firearms training exercises.

Figure 1:
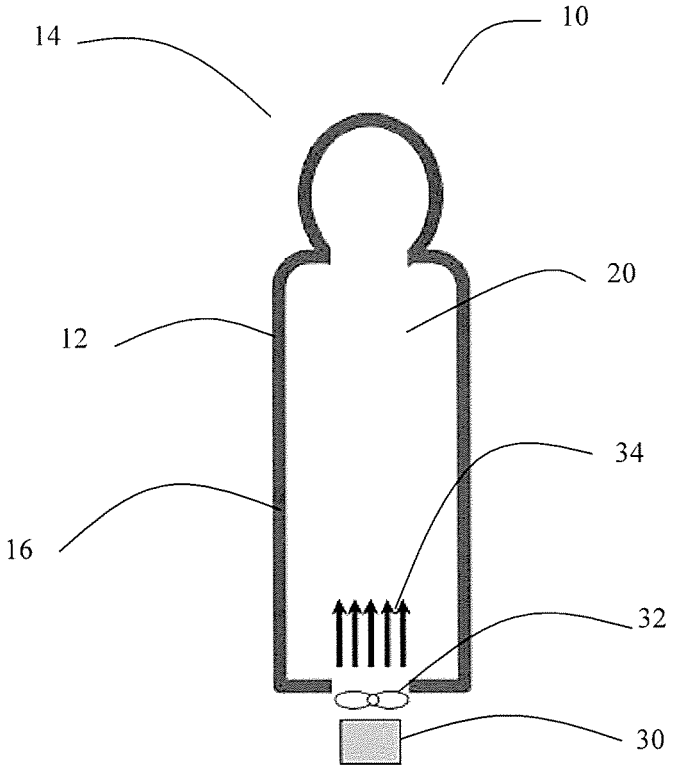
FIG. 1 is a schematic cross-sectional view of an embodiment of a target for use in training personnel in thermal imaging systems.

Referring to FIG. 1; a target 10 for use in training in the operation of thermal weapon sights is shown including a moulded plastic mannequin shell 12. The shell 12 is moulded to give the outer appearance of a person and includes a head shaped region 14 and a body shaped region 16. An internal cavity 20 extends throughout the entirety of the inside of the shell 20. The shell 12 is intended to be mounted on a mobile robotic base unit (not shown). The base unit includes a power supply in the form of a rechargeable battery, along with motors for driving the wheels and an onboard control system (see W02011/035363 for examples).

An electrically powered heat source in the form of heating element 30 is located outside of the cavity 20 to introduce heat into the cavity by convection. Heating element 30 is mounted in the robotic base unit (not shown) where it is protected from bullet strikes by reinforced armour plating provided on the base unit. The heating element 30 is powered by the battery located in the robotic base. A small electrically powered fan 32 assists in moving the warmed air upwards and into cavity 20. The warmed air in turn warms the shell 12 from the inside. The shell 12 therefore becomes of an elevated temperature compared to its surroundings and is viewable in a thermal scope as a human shape. In an alternative embodiment, the fan is omitted, although use of a fan results in faster heating.

In an alternative embodiment the heating element 30 can be omitted. Instead, waste-heat from the on-board systems housed in the robotic target base (for example from the motors or computer system of the robotic base) is channelled upwards and into the cavity 20. By mounting the heat source inside the robotic base, this approach to heating the mannequin has the advantage that there are no active parts within the target mannequin that can be damaged.

Figure 2:
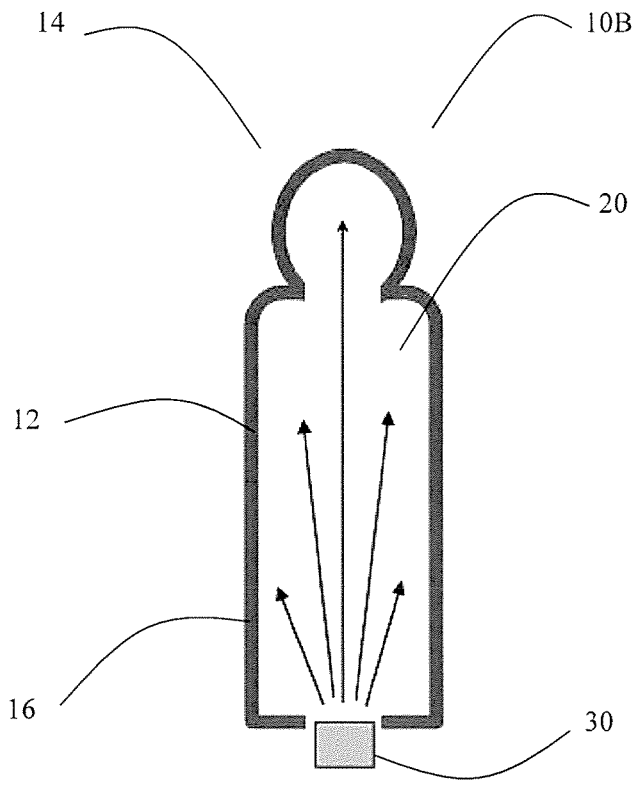
FIG. 2 is a schematic cross-sectional view of another embodiment of a target.

Referring to FIG. 2, an alternative embodiment of a target 10B is shown in which the heat source in the form of heating element 30 is mounted below the target, such that it can radiate heat up through the lower opening in the mannequin cavity 20. This embodiment has the same advantage as the first described embodiment, that the heat source can be kept completely out of the line of fire.

Figure 3:
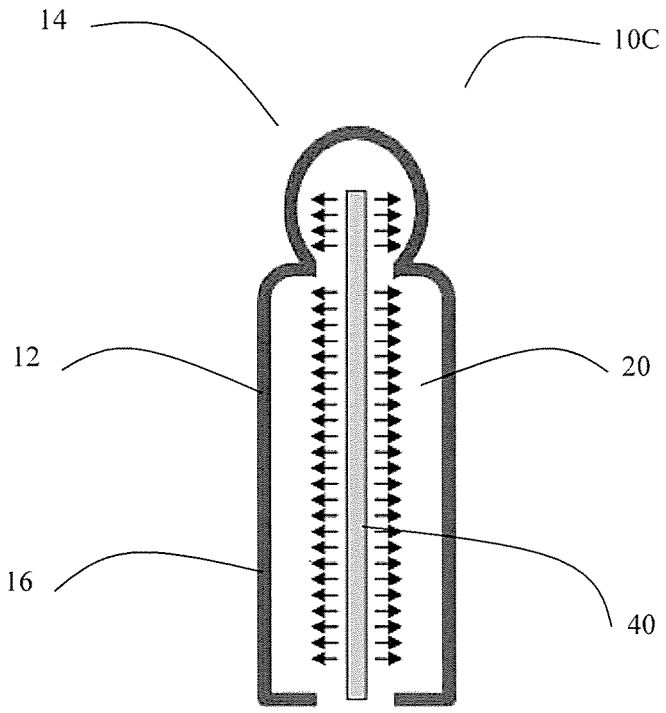
FIG. 3 is a schematic cross-sectional view of another embodiment of a target.

Referring to FIG. 3, a further alternative embodiment of a target 10C is shown in which the heat source in the form of heating element 40 is positioned inside the cavity 20 of mannequin shell 12. The heating element 40 radiates heat to thereby warm the inside surface of the mannequin shell 12. The internal element 40 is more vulnerable to live fire but offers the advantage of shorter time to heat up the target and more precise control of the temperature distribution.

Figure 4:
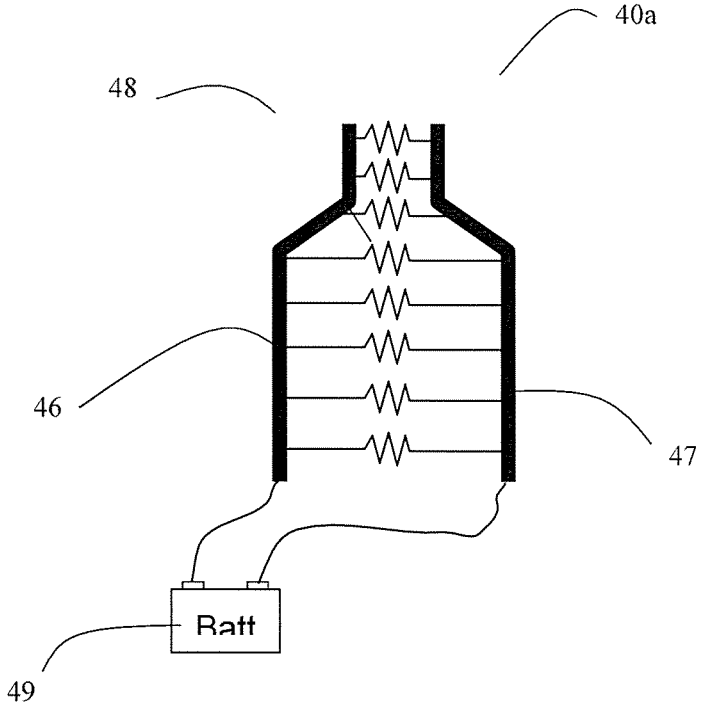
FIG. 4 shows an embodiment of a heating element for use in a target.
Figure 5:
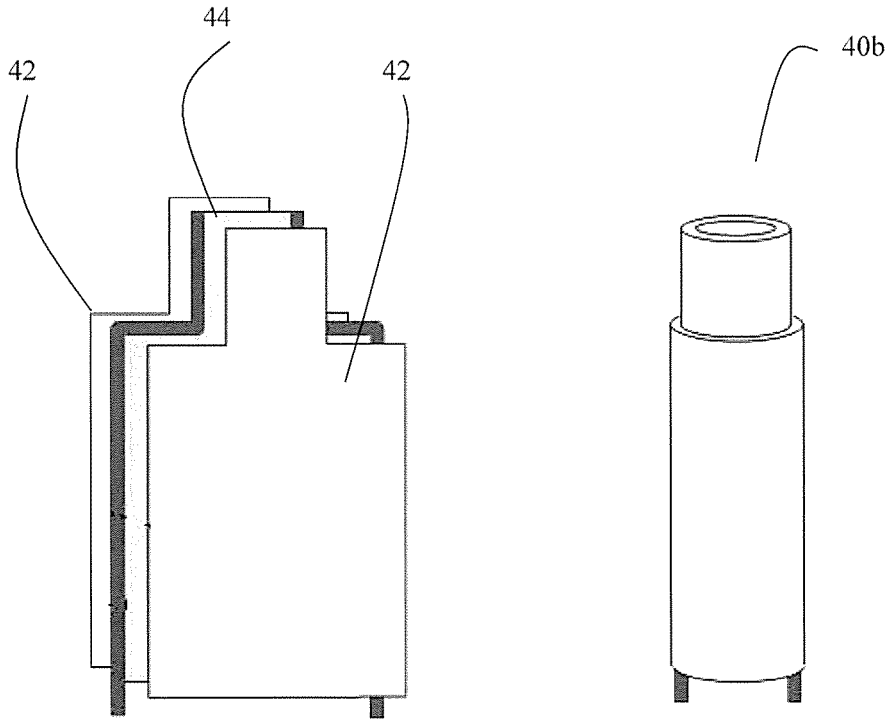
FIG. 5 shows an alternative embodiment of a heating element.

The internal heating element 40 needs to be resilient to bullet-strikes, and it helps if it is flexible (to allow the target to be assembled). Referring to FIGS. 4 and 5, two possible methods of providing an internal heating element are shown.

Referring to FIG. 4, a heating element 40a is shown which is formed by providing a non-conductive backing to which conductive tracks are applied. A series of resistive tracks 48 extend between bus bars 46, 47 to form a distributed resistor. When a voltage is applied across the bus-bars, the target heats up. It is possible to give the target a hotter head by using a uniform distributed resistor but a narrower region at the head (since resistance is proportional to resistor-length, and for a constant bus-bar voltage power is inversely proportional to resistance (P=V^2/R)). The bus-bars are made wider than the diameter of a bullet. If one of the resistive tracks 48 is pierced by a bullet then the heating effect of that track is lost.

Referring to FIG. 5, another version of heating element 40b is described which utilises a sheet of resistive fabric 44. Suitable fabrics are sometimes termed "warming" fabrics and are available from various suppliers such as from www.econyx.com. Sheet 44 is sandwiched between two outer layers 42 of a non-conductive and heat-tolerant material such as rubber. These outer layers act as a thermal and electrical insulator: (a) they prevent short-circuits when the assembly is rolled up, and (b) they prevent spot-heating from conduction should the heating-element touch the internal walls of the heated mannequin. The assembly is then rolled up to form a cylinder 40*b*.

Since the observer sees the heat of the outside surface of the mannequin, rather than looking at the heating element itself, minor damage to the heating element is not evident to the user and the heating element only needs to be replaced after it has suffered significant damage.

Figure 6:
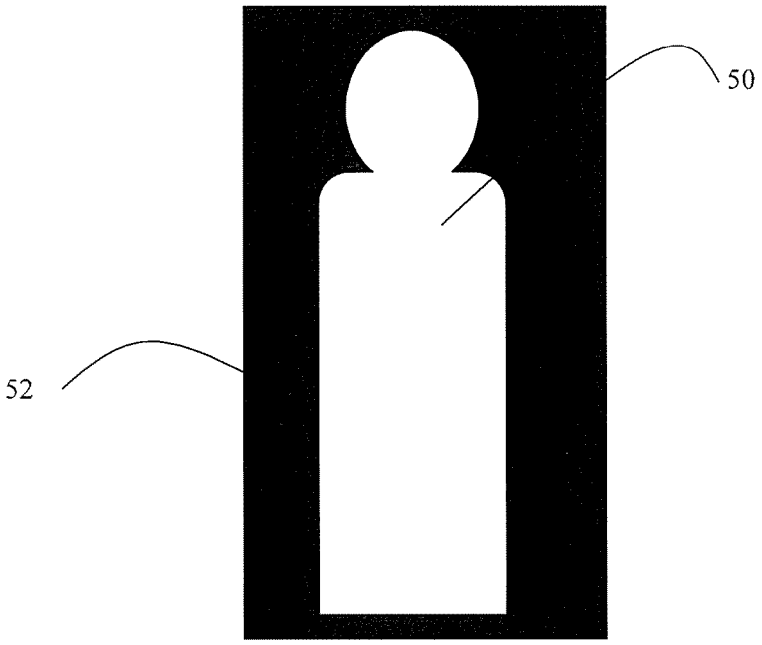
FIG. 6 shows the output of a thermal scope when viewing any of the targets of FIGS. 1 to 3.

Referring to FIG. 6, when viewed through a thermal imaging scope, any of the targets 10, 10B or 10C will produce an evenly distributed thermal signature 50 on the external surface of the mannequin. The background to the target is cold and so shows as a dark region 52. Note that the thermal signature is a crisp outline of the complex 3D shape. The firer sees a seamless picture without any hot-spots, cold-spots, or abrupt seams.

Figure 7:
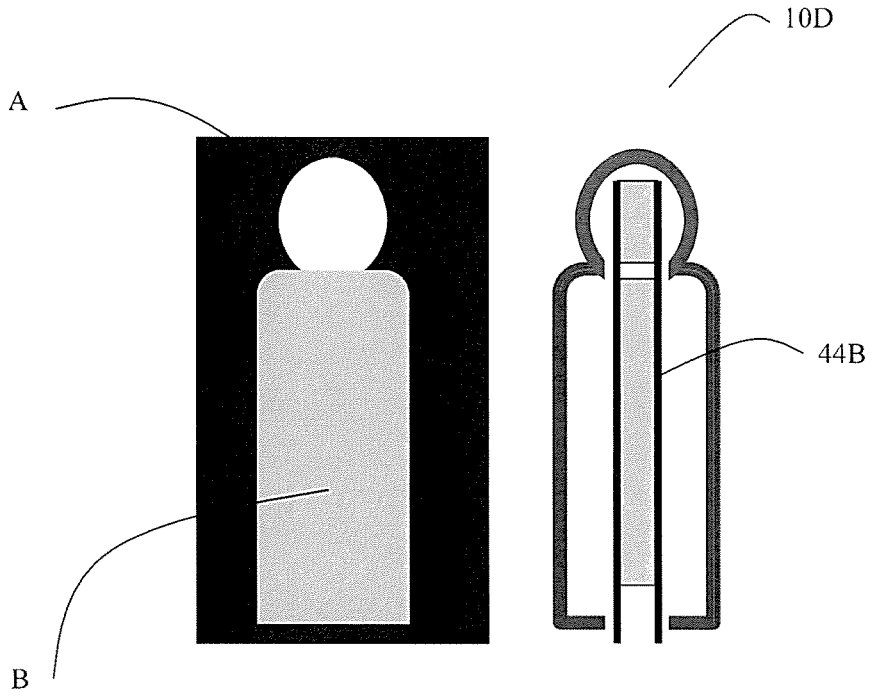
FIG. 7 illustrates an embodiment of a target with a non-uniform heating pattern.

Referring to FIG. 7, target 10D is shown at the right hand side of the figure and includes a modified version of heating element 44B which is configured to produce a non-uniform heating pattern by providing a higher heat intensity output in the top/head region of the heating element compared with the lower/torso region. The resultant heat signature is shown at the left hand side of the figure. It can be seen that the head region A shows in a lighter/warmer colour to the torso region B.

The effect of a hot head can also be achieved by putting clothing on the mannequin. This mirrors exactly the effect of putting clothing on a roughly-uniformly-heated person, leaving the exposed skin of the face noticeably hotter from the observer's perspective. Clothing could include shirts/jackets/pants (to create a hot head), hats/balaclavas/wigs/beards (to shape the desired thermal signature of the head), or glasses (which effectively block the thermal radiation to create an apparent dark zone).

The effect of a cold weapon can be produced by placing a passive insulating simulated weapon on the outside of the mannequin. This could take the form of a suitable shape cut out from a flat plastic panel.

Figure 8:
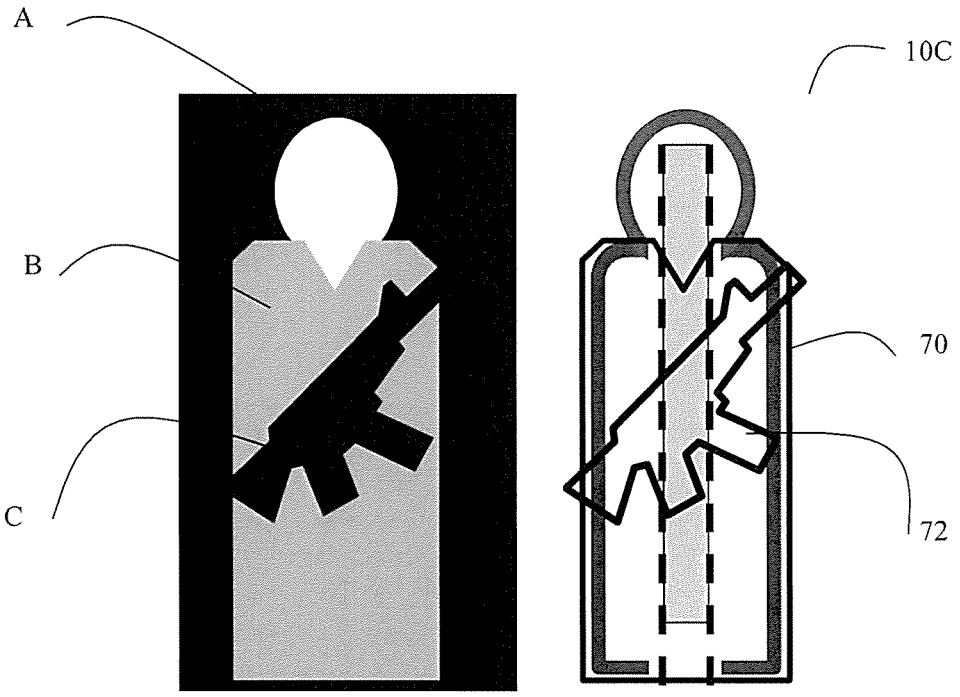
FIG. 8 illustrates an embodiment of a target adorned with heat insulating objects.

Referring to FIG. 8, target 10C is shown to the right hand side of the figure adorned with objects with heat insulating properties on the outside of the body in the form of clothing 70 and a plastic shape representing a weapon 72. The resulting heat signature is represented on the left side of the figure. It can be seen that the exposed head region A shows in the lightest/warmest shade, the clothed portion B of the target shows as slightly darker. The weapon shaped portion C shows the darkest/coldest area on the target.

Figure 9:
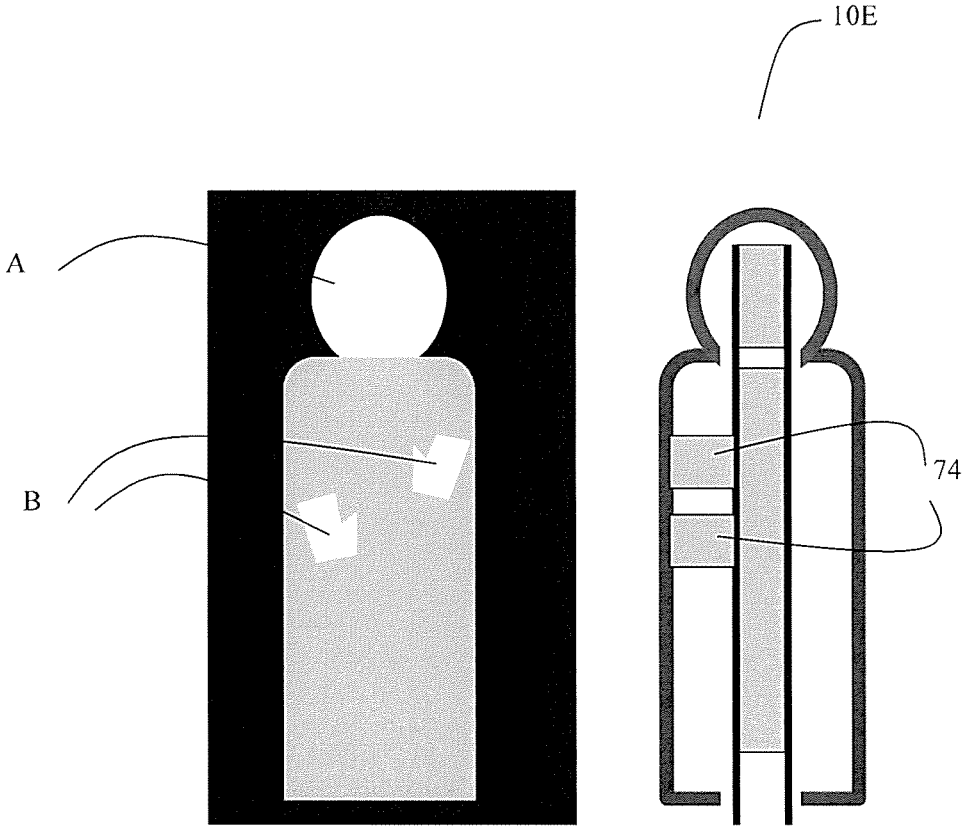
FIG. 9 illustrates an embodiment of target with hot-spots.

In addition to non-uniformity in the vertical direction, the internal element can be non-uniform in the horizontal direction in order to show interesting features such as hands. Referring to FIG. 9, target 10E includes a heating element which has higher intensity of heat output in the head region and also includes shaped projecting portions 74 which touch against the inner surface of the mannequin cavity. These projecting portions heat the inside surface of the shell cavity by conduction thereby creating a local host-spot for features such as hands B.

This principle of heating the interior of a hollow 3D volume can be readily applied to non-human targets such as vehicles. Vehicles often have hot spots (engine block, radiator, brakes, exhaust, tyres) which can be simulated using non-uniform heating pattern or by adjusting the heater location.

Figure 10:
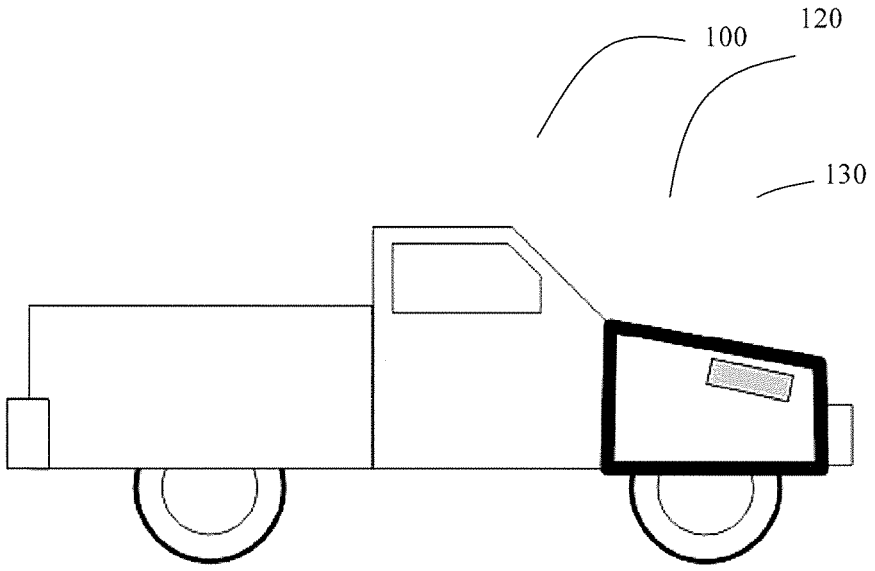
FIGS. 10 and 11 illustrate an embodiment of a target which has the outer appearance of a vehicle.

Referring to FIG. 10, a vehicle target 100 is shown which is formed in a 3D shape to resemble a small truck. An internal cavity 120 is provided to mimic the engine bay of the truck. A heating element 130 is located inside the cavity, and close to the upper inside surface of the cavity.

Figure 11:
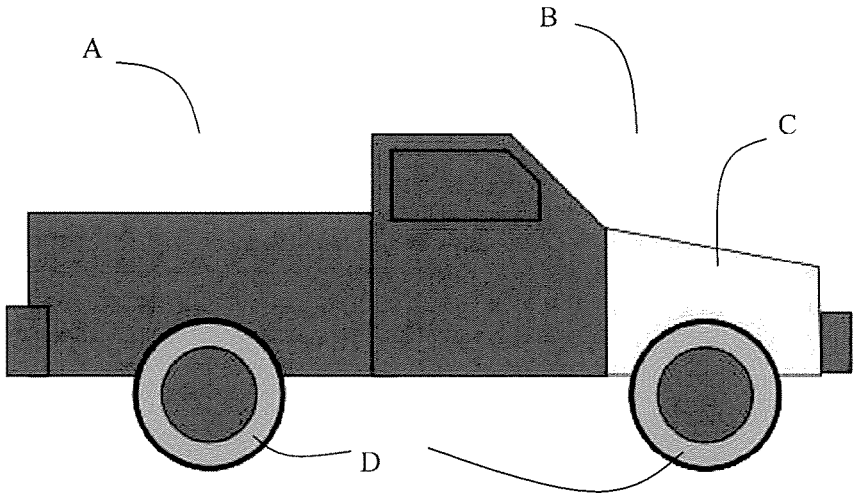

The thermal signature generated by target 100 is shown at FIG. 11. The main body of the truck A shows as a dark/cold colour. The engine cavity B shows slightly warmer, and a hotspot C is generated where the heating element 130 is positioned close to the inside surface. The tyres D of the vehicle also become warmed due to rolling resistance with the ground as the target moves around a training area, as would occur with a real truck.

Providing an electrically operated heat source means that it can be turned on/off remotely. This is important because it allows the targets to be set up well before shooting begins, without worrying about wasting power while waiting for the shooters to be ready and in position. It also allows to regulate the amount of heat: a large amount of power can be applied initially to warm up a cold target quickly, then the power can be reduced to maintain the desired temperature.

Another advantage of a controllable source is the ability to modify the temperature in accordance with a training scenario. For example, temperature could be increased when the target becomes agitated or engages in physical activity; or decreased if the human target is motionless or killed or the vehicle target's engine is switched off 20

Figure 12:
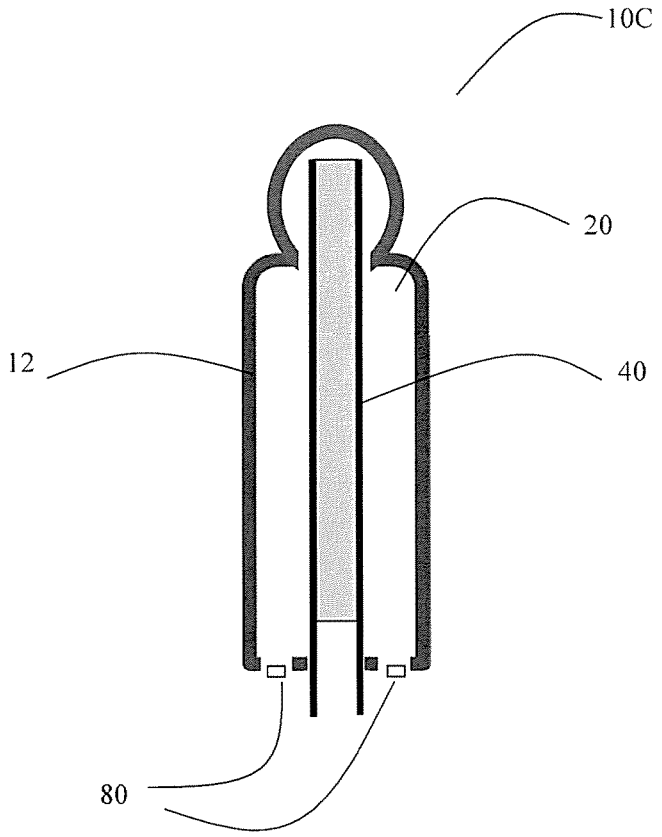
FIG. 12 illustrates an embodiment of a target which includes acoustic sensors for detecting bullet strikes.

The cavity inside the target can also be useful for acoustic detection of bullet-hits. Referring to FIG. 12, target 10C is shown further including acoustic sensors 80 which are mounted at the lower region of the cavity 20 to detect the sounds caused by bullet strikes. Mannequin 12 allows the sound to propagate through the captive volume of air within, while insulating the acoustic sensors 80 from sounds generated outside the hollow volume. Thus the hollow cavity 20 serves the dual purpose of aiding both hit-sensing and thermal signature.

Figure 13:
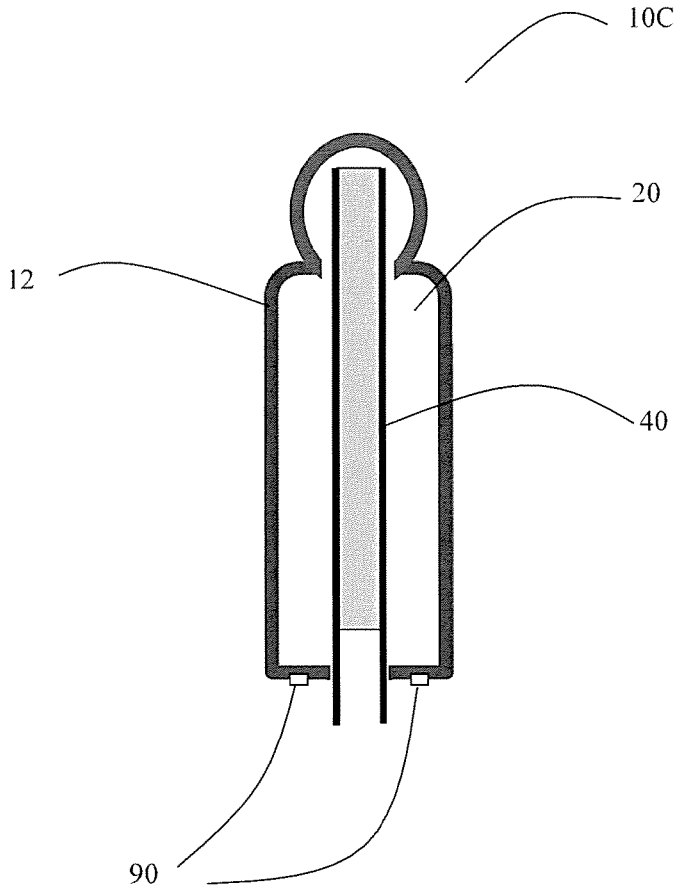
FIG. 13 illustrates an embodiment of a target which includes vibrational sensors for detecting bullet strikes.

Another method for detection of bullet-impacts is using vibration. Referring to FIG. 13, target 10C is shown further including vibration sensors 90 which are mounted at the lower region of the cavity 20 to detect the vibrations caused by bullet strikes. When a projectile impacts the dummy at high velocity, a shock wave propagates through the surface of the dummy. The vibration sensors can detect this shock-wave and indicate a hit.

Although embodiments of the invention have been described in applications involving mobile targets the invention is also applicable to static and pop-up targets.

Although embodiments of the invention have been described in applications for firearms training, it finds various applications including:

1. training to aim and shoot with firearms
2. training to aim and shoot using electronic training aids, including lasers.
3. training to aim and shoot from vehicles, including tanks
4. military and law enforcement training to observe, detect, identify, estimate speed, etc.
5. military and civilian training for search and rescue, e.g. helicopter crews looking for lost hikers in the woods.

Any reference to prior art contained herein is not to be taken as an admission that the information is common general knowledge, unless otherwise indicated.

Finally, it is to be appreciated that various alterations or additions may be made to the parts previously described without departing from the spirit or ambit of the present invention.

The invention claimed is:

1. A target for use in training personnel in an operation of a thermal imaging system, the target including:

an outer shell formed of a three dimensional molded plastic shell at least partially enclosing an internal cavity having air within a space defined by the internal cavity of the outer shell, the outer shell having an outer appearance of a person and comprises a head shaped region and a body shaped region; and an electrically powered heat source, wherein:

the heat source is located within the head shaped region of the internal cavity;

the heat source is spaced away from a three-dimensional inside surface of the head shaped region of the outer shell and the heat source does not contact the three-dimensional inside surface of the head shaped region of the outer shell;

the heat source is arranged to introduce heat to the internal cavity to thereby warm the three-dimensional inside surface of the head shaped region of the outer shell predominantly by radiation which passes through the air that separates the internal cavity from the three-dimensional inside surface of the head shaped region of the outer shell of the target to warm the inside surface of the cavity to thereby generate a heat signature.

2. The target according to claim 1 wherein the heat source is also at least partially located in the body shaped region of the target, such that the heat source is at least partially located in each of the head shaped region and the body shaped region of the outer shell.

3. The target according to claim 2 wherein the heat source is arranged to provide a higher heat intensity output in the head shaped region than in the body shaped region.

4. The target according to claim 1 wherein the heat source is formed from one or more planar layers which have been rolled up to form a heating element.

5. The target according to claim 4 wherein at least one of the one or more planar layers is formed from a resistive material.

6. The target according to claim 1 wherein the heat source is arranged to apply heat to predetermined regions of the three-dimensional inside surface of the internal cavity by conduction to create hot spots on the target.

7. The target according to claim 6 which further includes at least one object with heat insulating properties which overlies an area of the target which will become warm in use to thereby create a cold spot on the target.

8. The target according to claim 7 wherein the at least one object comprises at least one of eyewear, clothing, headgear, or simulated weaponry.

9. The target according to claim 1 further including at least one acoustic sensor which is arranged to detect sounds inside the internal cavity to thereby detect bullet strikes.

10. The target according to claim 1 further including at least one vibrational sensor which is arranged to detect vibrations of the outer shell of the target to thereby detect bullet strikes on the target.

11. The target according to claim 1 which is mobile and is arranged to move around a training area.

12. The target according to claim 1 wherein the heat source is both within the internal cavity and spaced apart from the three-dimensional inside surface of the outer shell by at least a portion of the air within the internal cavity.

13. The target according to claim 12 wherein the heat introduced to the internal cavity radiates to the three-dimensional inside surface of the outer shell via the at least a portion of the air within the internal cavity.

14. The target according to claim 1 wherein the three-dimensional inside surface of the head shaped region is shaped to be on at least two opposite sides of the heat source.

15. The target according to claim 1 wherein the three-dimensional inside surface of the head shaped region forms a perimeter that fully surrounds the heat source.

16. The target according to claim 1 wherein:

a first portion of the three-dimensional inside surface of the head shaped region is located above a top of the heat source; and a second portion of the three-dimensional inside surface of the head shaped region surrounds a plurality of sides of the heat source that is at least partially located within the head shaped region.

17. The target according to claim 1 wherein the internal cavity comprises a first cavity portion within the head shaped region of the outer shell and a second cavity portion within the body shaped region of the outer shell, and further wherein the first cavity portion and the second cavity portion together define the space in which the air exists within the internal cavity.

18. The target according to claim 1 wherein the target is attached to a mobile robotic base comprising a power supply, wheels, and at least one motor for driving the wheels.

19. The target according to claim 18 wherein the heat source is powered by the power supply in the mobile robotic base.

20. The target according to claim 19 wherein the power supply comprises a rechargeable battery.

21. The target according to claim 1 wherein the heat signature is produced and visible to a thermal imaging system from all sides of a three-dimensional outside surface of the head shaped region of the outer shell.

22. The target according to claim 1 wherein the heat source is configured to produce an evenly distributed thermal signature on a three-dimensional outside surface of the head shaped region of the outer shell.

23. The target according to claim 2 wherein the heat source is configured to produce an evenly distributed thermal signature on a three-dimensional outside surface of the body shaped region of the outer shell.

* * * * *